United States Patent [19]

Johnson et al.

[11] Patent Number: 4,662,150

[45] Date of Patent: May 5, 1987

[54] APPARATUS FOR ERECTING AND LOADING A PAPERBOARD CARTON MANUALLY

[75] Inventors: Richard H. Johnson, Arlington Hts.; Howard Selin, Morton Grove; Wayne H. Kuhn, Palos Park, all of Ill.

[73] Assignee: Stone Container Corporation, Chicago, Ill.

[21] Appl. No.: 834,581

[22] Filed: Feb. 28, 1986

[51] Int. Cl.[4] ..... B65B 5/02

[52] U.S. Cl. ..... 53/458; 53/381 R; 53/390; 53/564; 493/313

[58] Field of Search ..... 53/381 R, 382, 390, 53/458, 564; 493/309, 313, 417

[56] References Cited

U.S. PATENT DOCUMENTS

| | | | |
|---|---|---|---|
| Re. 30,921 | 5/1982 | McDowell | 53/564 X |
| 3,323,283 | 6/1967 | Johnson et al. | 53/566 |
| 3,420,036 | 1/1969 | Hutchinson | 53/566 |
| 3,477,349 | 11/1969 | Berney | 53/382 X |
| 3,605,377 | 9/1971 | Sabel | 53/564 X |
| 4,213,285 | 7/1980 | Mancini | 53/564 X |
| 4,479,345 | 10/1984 | Nord | 53/564 |

*Primary Examiner*—Robert L. Spruill
*Assistant Examiner*—Steven P. Weihrouch
*Attorney, Agent, or Firm*—Silverman, Cass, Singer & Winburn, Ltd.

[57] ABSTRACT

Apparatus for facilitating the manual erection and loading of a partially assembled paperboard carton blank. The machine includes a work table on which the carton blank is manipulated selectively to open the blank and close the bottom thereof by utilizing a vacuum system for selectively restraining major flaps forming the bottom wall of the carton. The opened carton blank remains immobilized on the work table for loading through the open upper end thereof. The major and minor flaps at said upper end then can be folded manually to close the loaded carton, after which the vacuum system can be deactivated to permit sliding of the loaded carton into a takeaway apparatus which can be a taping or sealing device or a conveyor for transporting the loaded carton to a remote work station, such as, for sealing. The table top may be pivotal. Also, the table top is provided with guide means for positioning the blank properly on the work table; said guide means can be adjustable for accommodating different sizes of box blanks thereon.

23 Claims, 10 Drawing Figures

FIG. 6
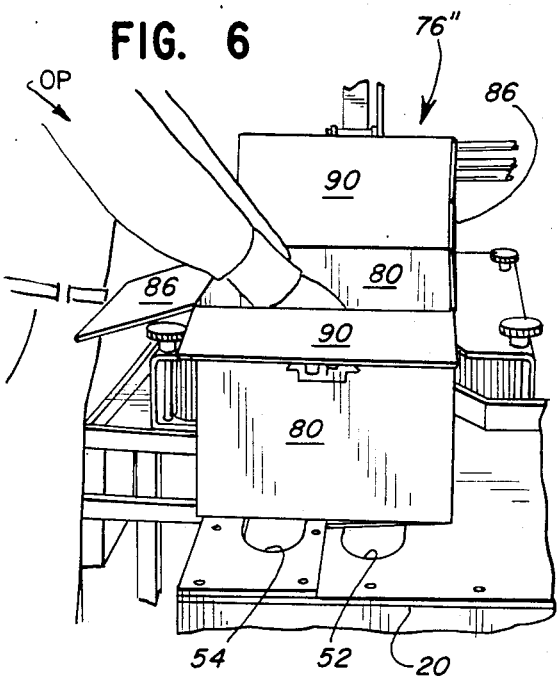
FIG. 7
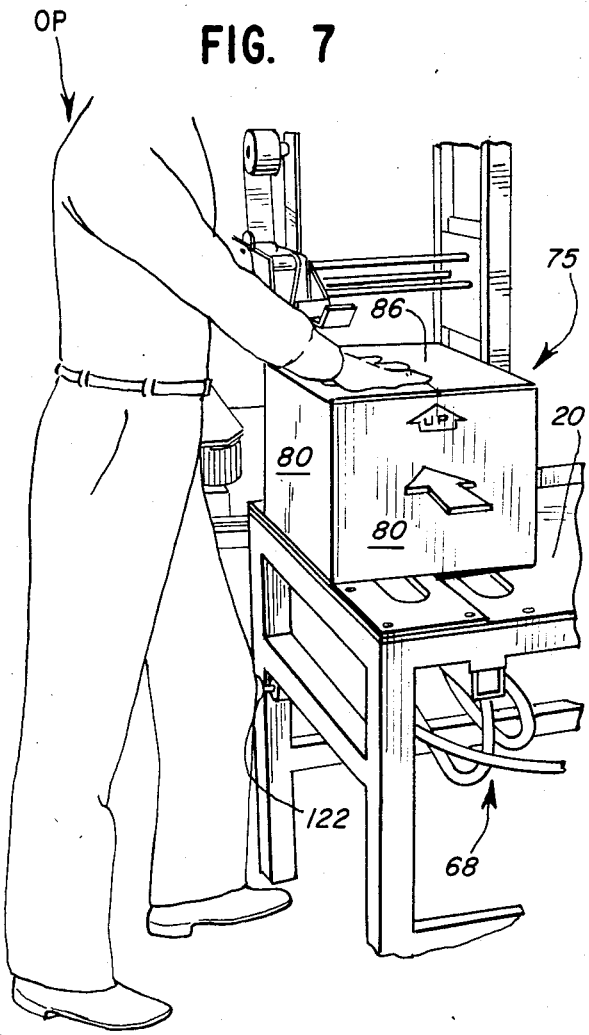
FIG. 8
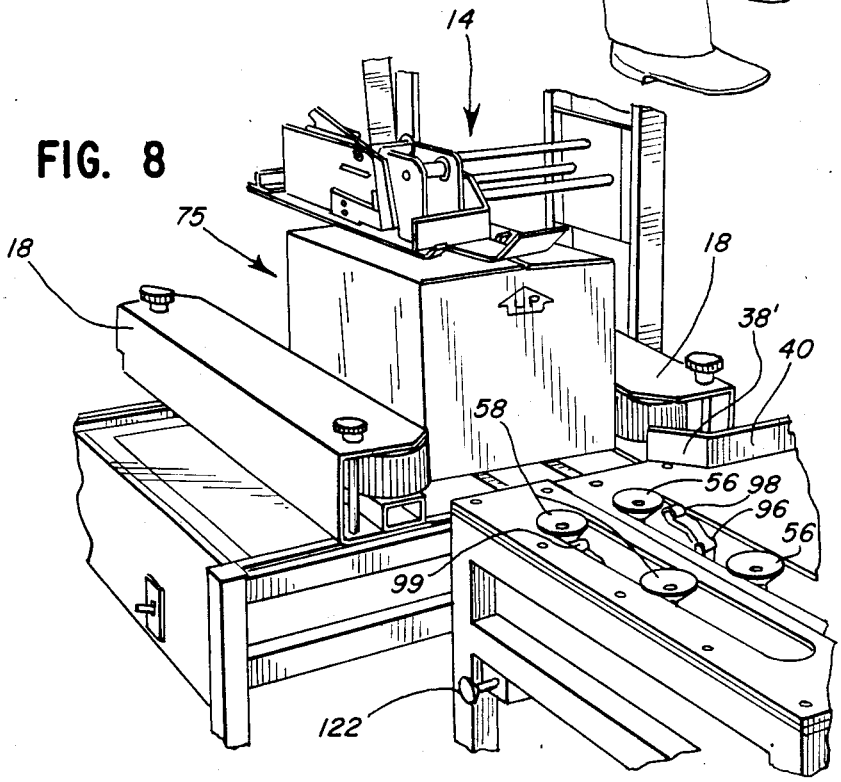
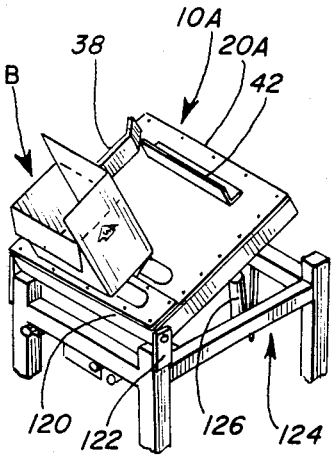
FIG. 9

APPARATUS FOR ERECTING AND LOADING A PAPERBOARD CARTON MANUALLY

BACKGROUND OF THE INVENTION

This invention relates generally to apparatus for manually erecting and loading corrugated paperboard cartons of the regular slotted container type commonly known as R.S.C. type and more particularly, provides apparatus for assisting an operator in the manual erection and loading of such type of carton from collapsed, partially assembled box blanks, said apparatus employing vacuum means for selectively immobilizing the box blank during its erection. The carton blank is partially assembled along its manufacturer's flap or joint, as is conventional in this field.

Conventional slotted containers and similar one piece boxes of the conventional R.S.C. type cartons of corrugated paperboard are manufactured and shipped to users in knockeddown or flat, partially assembled blanks, bundled or palletized, to be assembled and loaded by the user. This requires folding of major and minor flaps at both the upper and lower ends of the opened box blanks to form the top and bottom closure walls. High speed, automated equipment is available for the user to place bundles of blanks into a hopper or magazine of an automatic box erecting machine. The machine extracts single blanks from the magazine, and mechanically opens the blank into a tubular configuration, then folds and secures the four bottom flaps with tape, staples, or glue. The opened box then is loaded and thereafter, the top flaps are folded closed and sealed.

Problems arise for users when such an automatic box erecting machine is not feasible so that users must rely upon manual labor to erect and load the boxes and fold the flaps for sealing. Automatic box erecting machines are expensive and their economically feasible use demands large volume production and labor saving cost. This type of expensive machinery may not be feasible for many classes of customer users of such containers.

Erecting and/or loading of such paperboard cartons manually involves a relatively slow, tedious operation demanding considerable manual dexterity on the part of the operator. The difficulty is magnified because the paperboard from which the carton is formed causes the hinged flaps connected to the side panels to resist folding along the fold lines. The worker must not only fold the flaps, four in number on each of the top and bottom ends of the blank, but also must hold all the flaps in closed position for taping, gluing or stapling them into a closed formation. Not only is the process slow and requires considerable skill, but it engenders considerable strain and rapid operator fatigue also.

There is a real need for an economical apparatus which can assist the manual operator to open and load a carton blank speedily and without undue stress and fatigue during such operation.

SUMMARY OF THE INVENTION

Apparatus for assisting in the manual operations of erecting partially assembled paperboard carton blanks of the R.S.C. type and thereafter loading of the carton. The apparatus includes a work table having an elevated table top support surface with guide means for accurately positioning a carton blank thereon for subsequent manipulation by an operator. The table top has a pair of spaced apart slot formations in each of which is mounted vacuum cups exposed to the support surface.

Also associated with the slot formations is switch means connected to a vacuum system which is selectively activated when contacted by flap members forming the bottom wall of the carton. When so activated, the vacuum cups grip major flaps which form the bottom wall of the carton in a predetermined sequence when the carton blank is manipulated manually through a prescribed series of movements. This enables the vacuum cups to immobilize the carton blank in a vertical position open at its upper or top end for loading. After loading, the top closure wall is completed by folding flaps thereat. A switch is provided for deactivating the vacuum system so that vacuum cups release the flaps they engaged. The loaded carton can then be slid off the work table to an adjoining work station.

The guide means can be adjustable for accommodating different sizes of carton blanks on the work table. Also, the work table top can be pivotal whereby to assist further in loading of a carton.

BRIEF DESCRIPTION OF THE DRAWINGS

FIG. 6 is a fragmentary perspective view showing the operator loading the erected open-topped box;

FIG. 7 is a fragmentary perspective view showing the operator completing the erection and loading of the box using the apparatus of the invention and readying the completed loaded carton for feeding to takeaway means, here a taping machine;

FIG. 8 is a fragmentary perspective view illustrating the passage of the erected carton through the taping machine shown in FIG. 1;

FIG. 9 is a diagrammatic representation of the vacuum circuit for the apparatus of FIGS. 1 and 10.

DESCRIPTION OF PREFERRED EMBODIMENT

The apparatus of the invention will be described with respect to a container of the R.S.C. type. This type of container has rectilinear-shaped side panels joined along hinged fold lines and top and bottom closure walls formed by folding and/or tucking major and minor flaps likewise joined to opposite extremities of the side panels along fold or hinge lines. The reference to rectilinear-shaped panels is intended to include both rectangular and square side panels.

Figure 1:
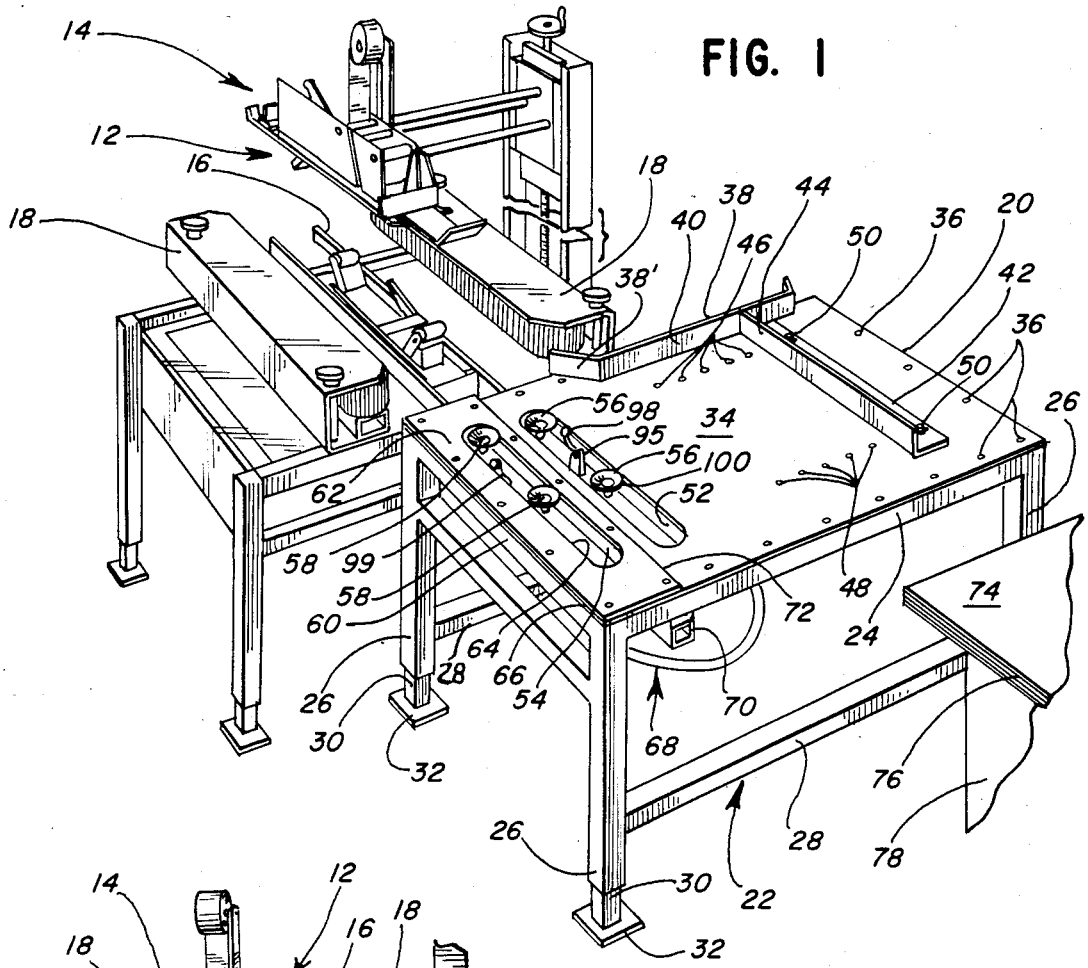
FIG. 1 is a perspective view of the carton erecting apparatus according to the invention illustrated in feed relation to a sealing machine, a portion of a collapsed box blank supply being shown.

Referring to FIG. 1, the carton erecting apparatus according to the invention is designated generally by reference character 10 and is illustrated to enable feeding of the erected and loaded cartons to a cooperating transport means, such as a conveyor, or the taping machine 12 illustrated herein. Taping machine 12 includes upper taping means 14, bottom taping means 16 and a pair of spaced apart drive belt assemblies 18 arranged to engage opposite sides of the erected box for drawing same through machine 12.

Apparatus 10 includes an elevated work table top 20 arranged on the supporting framework 22 having a horizontally oriented framing part 24 on which table top 20 is supported. Frame part 24 has depending legs 26 and horizontal braces 28, 28. Adjustable telescopic supports 30 are secured to foot pads 32. The rectangular table top 20 is secured on frame 24 by countersunk bolts 36. The top 20 may be provided with a work surface 34 of conforming size and configuration, preferably formed of low friction rigid plastic to reduce friction in moving the boxes or box blanks thereon during the set-up process. When referring to the table top 20, it is intended to include the work surface member 34 where the same is provided by a user. A stationary guide 38 is mounted fixedly on the table top 20. Guide 38 has an upstanding leg portion 40 cooperating with adjustable edge guide 42 having a vertical leg 44 oriented in a direction perpendicular to the vertical leg 40 across the width of top 20. A row of threaded openings 46 is provided in table top 20 and a matching row of threaded openings 48 also is provided in top 20 along a line parallel to the row 46. The adjustable guide 42 is mounted to the table top 20 by suitable bolts 50 seated in aligned openings 46 and 48 of the respective rows for selectively locating the guide 42 on the table top 20.

A pair of parallel slots 52 and 54 is formed in the table top 20 and pairs of vacuum cups 56, 58 are mounted within the respective slots 52 and 54 effectively opening to work surface 34. Slot 54 is formed adjacent the front 60 of the table top 20 and slot 52 is located adjacent slot 54.

A secondary or top plate 62 having slot 64 is fastened to the table top 20 in registry with slot 54 and with its edge 66 flush with the front end 60 of the table top 20. A suitable vacuum system 68 is carried by horizontal beam 70 secured to supporting framework 24 and is coupled to the respective vacuum cups 56, 58. The opposite edge 72 of the plate 62 extends vertically perpendicular to the top 20 so as to function as an edge guide to align the edge of one bottom major flap 88 on the erected box with the center of the entry passageway to the taping machine 12 or a conveyor, as will be explained in detail hereinafter.

Figure 2:
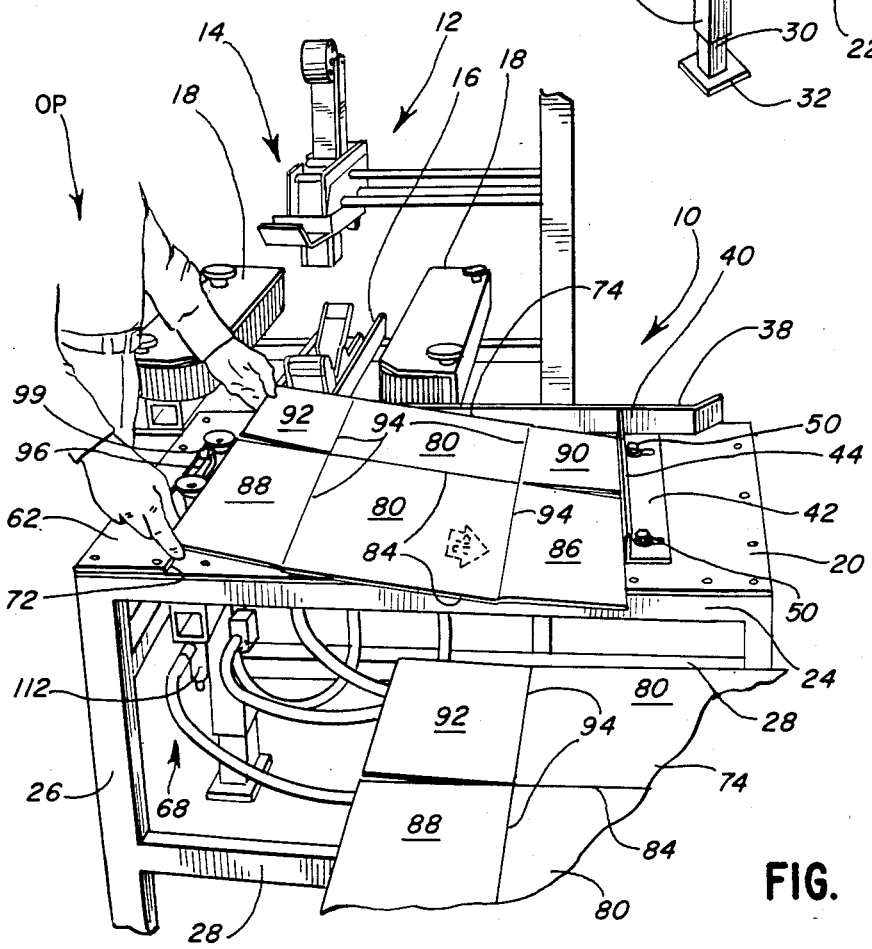
FIG. 2 is a fragmentary perspective view of the apparatus of FIG. 1 illustrating an operator performing the initial operation in the erection of a box using the apparatus according to the invention.

Referring to FIGS. 1 and 2, the manner of using apparatus 10 will be described with regard to the process of manually erecting a carton from a blank 74 which is partially assembled and in a flattened condition initially. As seen in FIG. 2, blank 74 is the uppermost one of a stack 76 of blanks 74 on an adjacent table 78. This is its condition when received from the manufacturer of the blank and placed on table top 20. The blank 74 preferably is of the R.S.C. type which will be comprised of four side panels 80 joined along common edges by fold lines 84. The panels 80 are provided with top and bottom major flaps 86, 88 and minor flaps 90, 92 respectively joined to the side panels along the fold or hinge lines 94.

The table top 20 first is positioned so that the elevated or rear edge 72 of top plate 62 is aligned with the exact center line of the taping machine 12. The height of the table top surface 20 is adjusted via the adjustable leg supports 30 so that the erected and/or loaded box 75 will pass easily from the surface 34 of the table top 20 to station 12. The foot pads 32 may be fastened to the floor to assure maximum stability. The flared section 38' of stationary guide 38 on table top 20 guides the erected boxes to the station 12. The rear or movable guide 42 is installed so that the collapsed box blank 74 will be positioned on the work surface 34 with edges of bottom flaps 88, 92 against guide edge 72 of the top plate 62 at the index line and edges of the top flaps 86, 90 in contact with the back guide 42.

The height of the two limit switches 95, 96 is adjusted so that the rollers 98, 99 thereof clear the vacuum cups 56, 58 and protrude approximately ¼" above the surface of the table top 34 and top plate 62 respectively. The switches 95, 96 are adjustable merely by loosening their mounting screws (not shown) and moving the rollers 98, 99 thereof up or down in suitable slots (not shown) formed in mounting brackets (not shown). The vacuum cups 56, 58 are adjusted vertically so that their respective rims 100 (FIG. 4) are flush with, or slightly above the surface 34 of the table top 20 and/or the top plate 62 as appropriately located. Each of the cups 56, 58 is adjustable vertically by means of a set screw in the bracket plate bearing against the vacuum pipe (not shown).

The box blank 74 is positioned against the edge guide 72 and guide legs 40 and 44 so that on the underside of the box blank 74, the major flaps 88 and 86 lead the minor flaps 92 and 90 in the direction of travel of the box blank. The vacuum cups 56, 58 are located so that they will be able to be aligned with appropriate major flaps respectively when the blank is positioned against the side guide 38 and manipulated thereafter for erecting the same.

As illustrated in FIG. 2, the operator is shown placing the box blank 74 on the table top 20 with edges thereof placed against the rear guide 42 and side guide 38. The act of placing the box blank 74 on the table top 20 activates the limit switch 95, by depressing the roller 98 projecting slightly above the level of the table top 20 thus energizing the vacuum pump 112. The vacuum cups 56, 58, although co-planar with or elevated slightly above the level of the table top 20, grip the bottom major flap 88 on the underside of the box blank 74 and thereby immobilize the box blank 74 on the table top 20.

Figure 3:
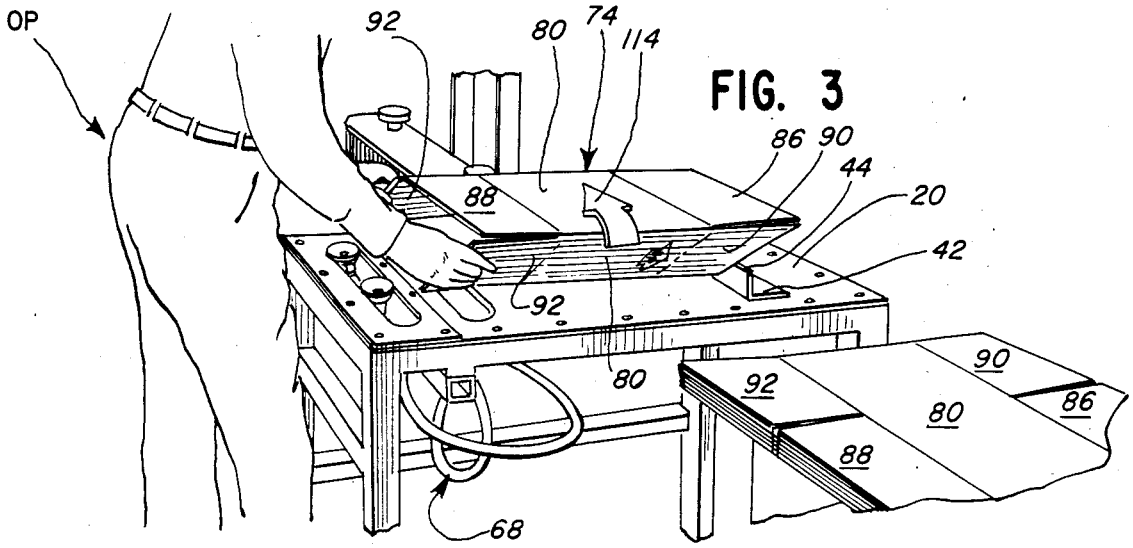
FIG. 3 is a fragmentary perspective view of the apparatus of the invention illustrating an operator performing a second step in the erection of a box using the apparatus according to the invention.
Figure 4:
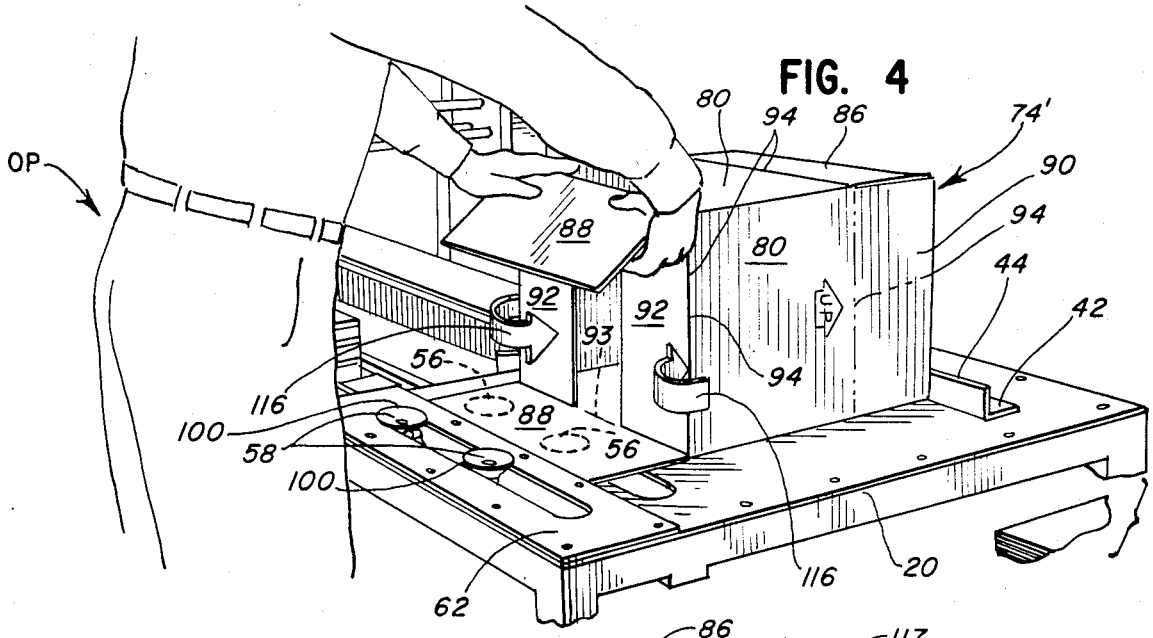
FIG. 4 is a fragmentary perspective view of the apparatus of the invention illustrating an operator performing the next step in the erection of a box using the apparatus according to the invention.

While the box blank 74 is so immobilized, as shown in FIG. 3, the operator OP grasps opposing minor flaps 92 of box blank 74, and, in a lifting motion using both hands, as shown by arrow 114, forms an open ended sleeve 74' supported by a side panel 80 on table top 20, as seen in FIG. 4.

Figure 5:
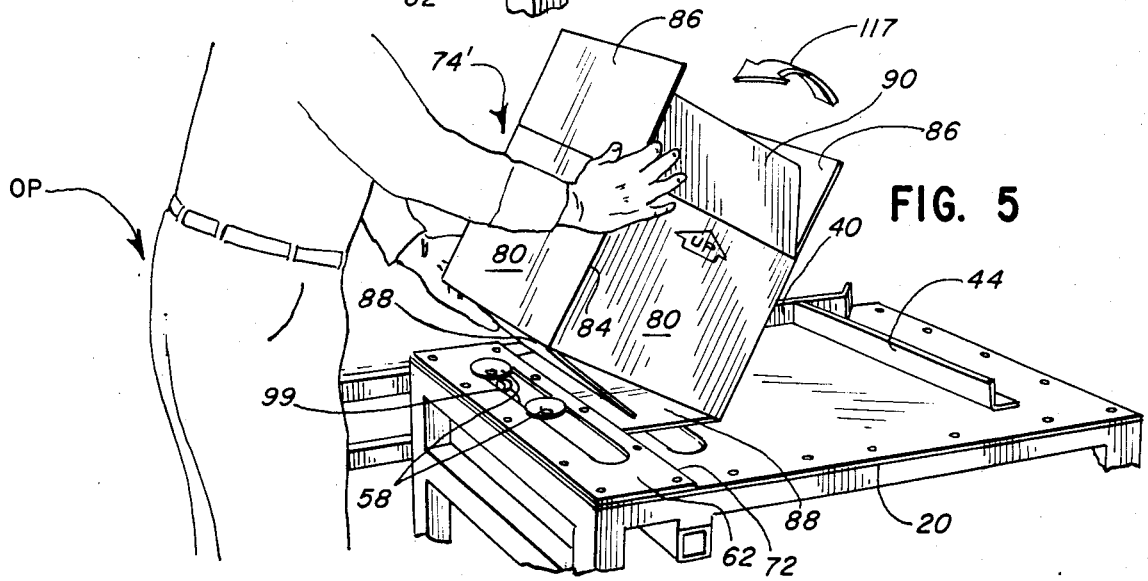
FIG. 5 is a fragmentary perspective view showing the operator performing the fourth step in the erection of a box using the apparatus according to the invention.

Referring now to FIG. 4, with one hand at each of the upper corners, the operator folds the minor flaps 92 inwardly from either side in the direction of arrows 116 and folds the upper major flap 88 downwardly thereby trapping the minor flaps 92. The lower major flap 88 is still held securely by the vacuum cups 56. As shown in FIG. 5, the operator pivots or tilts the partially erected box toward himself about the fold line 93 (seen in FIG. 4) in direction of arrow 117, and, with the left hand, as the box reaches an upright condition, he tucks the bottom major flap 88 between the minor flaps 92 and the top plate 62. The bottom major flap 88 is thus trapped beneath the erected box as is the other major flap 88 whose edge rests against the edge 72 of the top plate 62. Now, the erected but yet unsealed box 76'' can be loaded with product, as shown in FIG. 6.

In FIG. 7, the operator is shown immediately after folding the major and minor top flaps to close the upper end of the carton 75. After this manipulation is completed, the operator actuates a suitable switch to deactivate the vacuum system by engaging the knob 122 with his left knee. Now, the vacuum system is deactivated so that the operator can slide the box 75 from the table top 20 into the taping machine 12 for simultaneously sealing both the top and bottom of the box, as shown in FIG. 8. The centerline edge guide, with which one bottom flap 88 is in contact, serves to keep the erected box centered with respect to the entry path to the taping machine or, if desired, a conveyor provided in lieu thereof to transport the erected and loaded containers to another remote station for sealing thereof.

Referring to FIG. 9, a modified embodiment of the invention is designated by reference character 10A. Generally, it is identical to apparatus 10 except that the table top 20A is pivotal about its front edge 120 by the coupling thereat to brackets 122 fastened to the table frame 124. A pneumatic cylinder 126 is mounted beneath the table top 20A within the frame 124, its plunger end (not shown) being secured to the underside of the table top 20A. When efficient loading of a box B requires the table top 20A to be tilted while the box B is being filled, the table top 20A can be lifted, tilted and lowered, as required, during the loading operation; the same two pairs of vacuum cups 56 and 58, not seen, are operable to hold both the bottom major flaps of the box securely for loading even in the tilted position of the table top illustrated.

Figure 10:
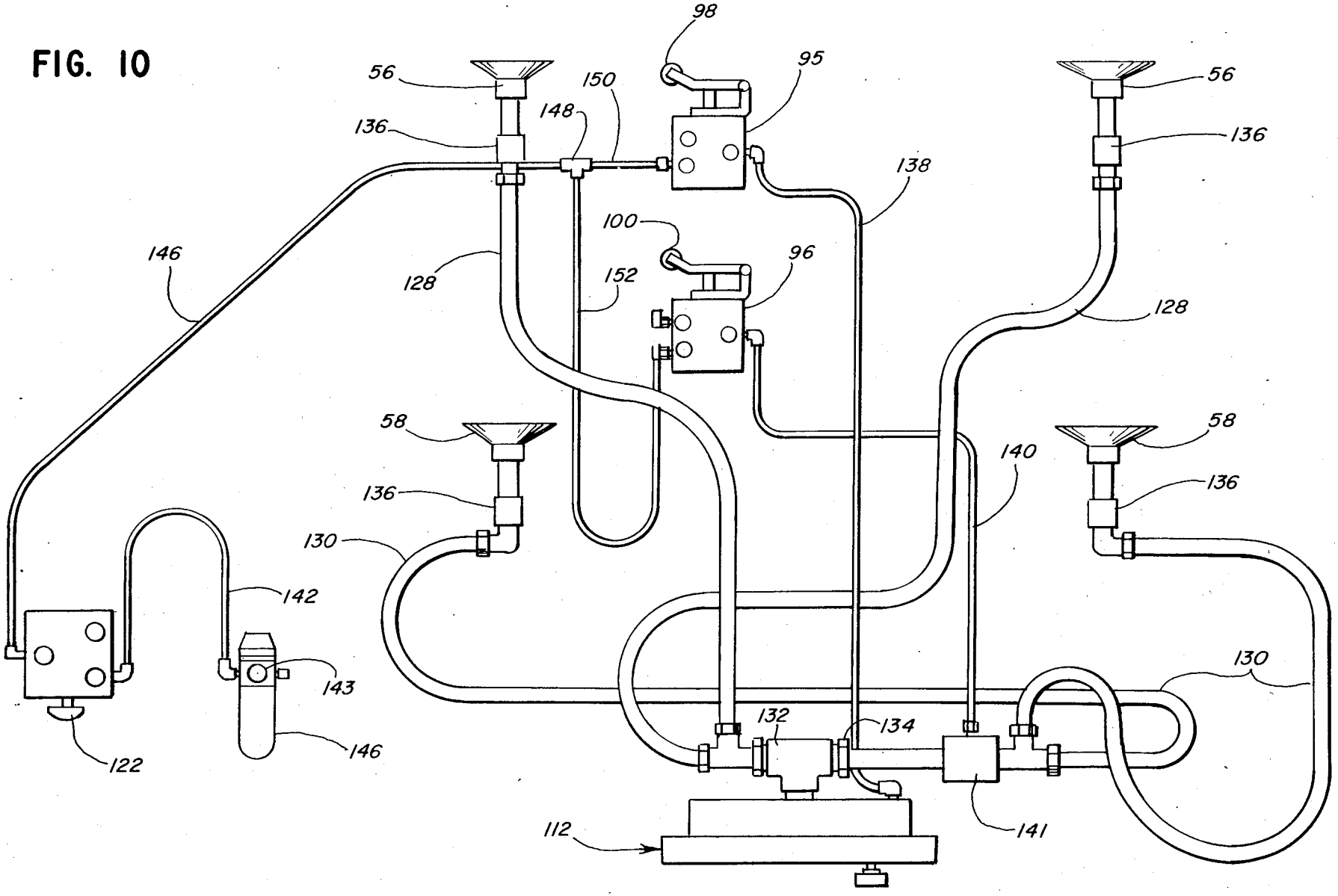
FIG. 10 is a reduced perspective view of a modified embodiment of the invention incorporating a tilting work table top.

The fluid circuitry of the vacuum system employed in the preferred embodiments of the invention is illustrated diagrammatically in FIG. 10. Vacuum cups 56 and 58 are shown coupled to the vacuum pump 112 along conduits or lines 128 and 130, coupling 132, reducers 134, and connector 136, respectively. The limit switch 95 is coupled to the vacuum pump 112 via line 138. Limit switch 96 is coupled to the vacuum control valve 141 by line 140. Limit switches 95 and 96 are coupled to each other by way of conduits or lines 150 and 152, respectively and the T-coupling 148 and to the push button switch 122 by line 146. The push button switch 122 is mounted for access by the operator. Line 142 connects the push button switch 122 to the pressure gauge 143 and filter regulator 146.

The box erecting machine 10 can be alternated easily between a four cup operation and a two cup operation, as required, when bottom sealing without loading is desired. The push button switch 122 is not employed during two cup operation. Line 142 is disconnected from switch 122 and connected to limit switch 96. Line 140 is removed from vacuum control valve 141 and connected to limit switch 95 after disconnecting line 150 from limit switch 95. Line 152 is disconnected from limit switch 96. Lines 146, 150, and 152 are not used for two cup operation and are tied off. Plate 62 is removed and vacuum cups 58 are lowered.

For the two cup operation, the top plate 62 is replaced with a plate, not shown, which is identical in all respects but for elimination of the slot 64, yet being provided with port means to accommodate the switch roller 99.

The apparatus 10 is readily adjustable to accommodate a wide range of box sizes. Adjustment is quick and simple by generally involving only the rear guide 44 and occasionally the vacuum cups. The machine 10 can be set up to operate in either direction, i.e., right to left or left to right.

Although the preferred embodiments described and illustrated discuss elongated slot formations 52 and 54 and pairs of circular vacuum engaging cups 56 and 58 in these slots for immobilizing the major flaps 88 of the R.S.C. type carton, variations are possible within the scope of the invention. For instance, a single opening may be provided in registry with a vacuum cup instead of an elongated slot formation to accommodate a pair of vacuum cups. Also, a single enlarged vacuum cup suitably exposed to engage and immobilize a major flap 88 is feasible. Obviously, the configuration of the vacuum cup can vary within feasible limits so long as its desired function is achieved.

What I claim is:

1. A machine for manually erecting and loading a box formed from a partially assembled box blank of the general regular slotted container type which includes a plurality of side panels hingedly connected together and opposite pairs of major and minor flaps hingedly connected to opposite extremities of said panels for forming upper and bottom closure walls of the box when erected and loaded, the box blank arranged to be fed to the machine in a flattened or collapsed condition; said machine including:

A. A table having a horizontally oriented work top for supporting a partially assembled box blank thereon;

B. first and second access opening means extending through said work top;

C. first vacuum holding means positioned in said first access opening means for physically engaging a first flap of the box blank supported on the work top;

D. second vacuum holding means positioned in said second access opening means for physically engaging a second flap of the box blank supported on the work top;

E. a vacuum system operatively coupled to said first and second vacuum holding means;

F. first switch means coupled to said vacuum system and said first vacuum holding means operable to activate the vacuum system for holding said first flap so engaged;

G. second switch means coupled to said vacuum system and said second vacuum holding means operable to activate the vacuum system for holding the second flap so engaged;

H. guide means located on said table top for selectively positioning a box blank on said work top such that said first flap is engaged by the first vacuum holding means and activation of the vacuum system immobilizes said first flap on the work top whereby said box blank can be manually manipulated to form an open-ended sleeve formation thereof; and I. said box blank thereafter being pivotal relative to said first flap and said work top to enable the second flap to be engaged by the second vacuum holding means for further immobilizing the said sleeve formation in a position extending laterally from said work top and with the bottom closure walls completely formed and upper closure walls open for loading the box.

2. The machine of claim 1 in which said guide means includes elevated guide formations relative said work top defining a configuration which conforms to the rectilinear configuration of the partially assembled box blank supported on the work top.

3. The machine of claim 2 in which said guide means comprise a first pair of elevated edge guides arranged normal one relative the other and a second elevated edge guide substantially parallel to an edge guide of said first pair.

4. The machine of claim 1 in which said guide means includes an elevated guide edge positioned to be engaged by a longitudinally extending edge of said first flap.

5. The machine of claim 4 in which said first flap is a major flap which is connected to a side panel to form the bottom closure.

6. The machine of claim 5 in which said second flap is a major flap which is connected to a side panel to form the bottom closure.

7. The machine of claim 4 in which said elevated guide edge is located to provide a discharge path of movement for the erected box to a work station displaced from the machine.

8. The machine of claim 1 in which each of said vacuum holding means comprise vacuum cup members.

9. The machine of claim 1 in which each of said access opening means comprise slot formations displaced one from the other on said table top.

10. The machine of claim 4 in which said table top includes a plate member secured thereon having access opening means in registry with said second access opening means and a lateral edge thereof which coincides with said elevated guide edge.

11. The machine of claim 4 in which said first pair of edge guides are adjustable one relative to the other for accommodating different sizes of box blanks properly positioned on the work top.

12. The machine of claim 1 in which said vacuum system includes a switch means for selectively deactivating said system whereby the erected box no longer is immobilized on the work table.

13. The machine of claim 1 in which said vacuum system is activated automatically by the engagement of the first and second flaps with the first and second switch means respectively.

14. The machine of claim 3 in which said second edge guide is fixed on the table top.

15. The machine of claim 1 in which said work top is pivotally mounted for displacement from its horizontal orientation.

16. A method for manually erecting and loading a box formed from a partially assembled box blank generally of the regular slotted container type which includes a plurality of side panels hingedly connected together and opposite pairs of major and minor flaps hingedly connected to opposite extremities of said panels for forming the upper and bottom end closure walls of the box when erected and loaded, the box blank being in a flattened or collapsed condition, said method comprising the steps of:

A. providing a table having a horizontally oriented work top carrying first and second aperture means opening to the work top and first and second vacuum cup means respectively supported in said first and second aperture means, first and second switch means in each of the respective aperture means proximate the vacuum cup means therein, and guide means associated with the work top for selectively positioning the box blank on the work top relative to the aperture means, vacuum cup means and the switch means for erecting and loading the formed box;

B. positioning a box blank flat on the work top relative to the guide means, the aperture means and switch means to engage said first switch means and activate the vacuum system;

C. applying suction to said first vacuum cup means to hold a first contiguous major flap at the bottom closure end to immobilize said first major flap on the work top;

D. manipulating the box blank manually to open same to a tubular configuration while the first major flap is so immobilized on the work top;

E. continuing the application of vacuum while manipulating the minor flaps of the tubular formation to partially form the bottom end closure; and F. manipulating the box blank to position a second contiguous major flap over said second vacuum cup means and overlying said minor flaps to complete the bottom end closure and applying a vacuum draw against said second major flap to immobilize the tubular formation in a vertical orientation with the upper end closure walls open.

17. The method of claim 16 including inserting lading into the vertically oriented box blank and thereafter folding the flaps to complete the upper end closure while the blank is still immobilized.

18. The method of claim 16 in which said guide means includes an adjustable elevated guide edge on said work top which enables different sizes of box blanks to be erected and loaded thereon.

19. The method of claim 17 in which said guide means includes a second elevated guide edge parallel to said adjustable guide edge, said elevated guide edge being selectively located to align centrally with the entrance to a work station into which the erected and loaded box can be moved from the work top when the vacuum system is deactivated.

20. The method of claim 16 which includes providing a work station adjacent to the work top having an entrance for receiving said erected and loaded box from the work top, loading said box and forming the upper end closure, deactivating the vacuum system so as to release the erected box for movement to said work station.

21. A method for manually erecting and loading a box formed from a partially assembled box blank of the regular slotted container type which includes a plurality of side panels hingedly connected together and opposite major and minor flaps hingedly connected to opposite extremities of the panels for forming upper and bottom closure walls of the box when erected and loaded, the box blank being in a flattened or collapsed condition, said method comprising the steps of:

A. placing the box blank on a work surface having first and second slot means each containing first and second vacuum cup means and first and second switch means for activating a source of vacuum coupled to the first and second vacuum cup means, the placement of the box blank on the surface engaging said first switch means to activate said first vacuum cup means;

B. immobilizing a first major flap of the box blank on the table by applying suction to said first vacuum cup means to hold said first major flap at the bottom end thereof;

C. manipulating the immobilzed box blank to open the box blank to a tubular formation;

D. maintaining the box blank immobilized while folding the minor flaps inward with the first vacuum cup means engaged with said major flap;

E. pivoting the partially erected, partially closed box blank to engage a second major flap with the second vacuum cup means and applying suction to said second vacuum cup means to hold said second major flap and thereby bringing the said tubular formation to a vertical orientation on said surface with its upper end open and exposed for loading thereof; and F. thereafter, releasing the suction to free the erected box for transport to a second location.

22. The method of claim 20 in which said upper end closure is completed by manipulating the flaps thereof prior to transport of the box to a second station.

23. The method of claim 20 which includes providing an elevated guide edge for the erected box which is aligned centrally with the entrance to the work station along which said box movement occurs.

* * * * *